United States Patent [19]

Gill

[11] Patent Number: 4,706,620

[45] **Date of Patent: * Nov. 17, 1987**

[54] AUTOMATIC CLEARANCE ADJUSTER

[75] Inventor: Peter J. Gill, Wolverhampton, Great Britain

[73] Assignee: GKN Technology Limited, Wolverhampton, Great Britain

[ * ] Notice: The portion of the term of this patent subsequent to Oct. 22, 2002 has been disclaimed.

[21] Appl. No.: 829,648

[22] PCT Filed: Jun. 24, 1985

[86] PCT No.: PCT/GB85/00276

§ 371 Date: Jan. 31, 1986

§ 102(e) Date: Jan. 31, 1986

[87] PCT Pub. No.: WO86/00371

PCT Pub. Date: Jan. 16, 1986

[30] Foreign Application Priority Data

Jun. 27, 1985 [GB] United Kingdom ..... 8416352
Jun. 27, 1985 [GB] United Kingdom ..... 8416354

[51] Int. Cl.[4] ..... F01L 1/22
[52] U.S. Cl. ..... 123/90.54; 123/90.45
[58] Field of Search ..... 123/90.54, 90.51, 90.45, 123/90.48, 90.52

[56] References Cited

U.S. PATENT DOCUMENTS

| | | | |
|---|---|---|---|
| 1,817,620 | 8/1931 | Hamilton | 123/90.54 |
| 1,905,888 | 4/1933 | Berry | 123/90.54 |
| 1,983,127 | 12/1934 | Fredrickson | 123/90.54 |
| 2,050,766 | 8/1936 | Russell | 123/90.54 |
| 2,131,507 | 9/1938 | Goodwin | 123/90.54 |
| 2,211,585 | 8/1940 | Rushmore | 123/90.54 |
| 2,222,138 | 11/1940 | Burkhardt | 123/90.54 |
| 2,947,296 | 8/1960 | Skinner | 123/90.54 |
| 3,118,322 | 1/1964 | Oldberg et al. | 123/90.54 |
| 3,376,860 | 4/1968 | Johnson et al. | 123/90.43 |
| 4,366,785 | 1/1983 | Goloff et al. | 123/90.51 |
| 4,548,168 | 10/1985 | Gill | 123/90.54 |

FOREIGN PATENT DOCUMENTS

| | | | |
|---|---|---|---|
| 32284 | 7/1981 | European Pat. Off. | 123/90.54 |

*Primary Examiner*—Ira S. Lazarus
*Attorney, Agent, or Firm*—Marshall, O'Toole, Gerstein, Murray & Bicknell

[57] ABSTRACT

A mechanical automatic clearance adjuster, such as may be used as a valve clearance adjuster in an internal combustion engine, comprises a self-contained mechanism having an internally screw threaded housing (26) within which there is a complementarily threaded screw member (28). The screw threads exhibit a relatively high friction in one direction of axial loading thereof compared with a relatively low friction in the opposite direction of axial loading whereby the screw member (28) may rotate and advance axially of the housing (26) solely under the action of a compression spring (34) acting between the screw member (28) and an end cap (30).

6 Claims, 6 Drawing Figures

FIG.2
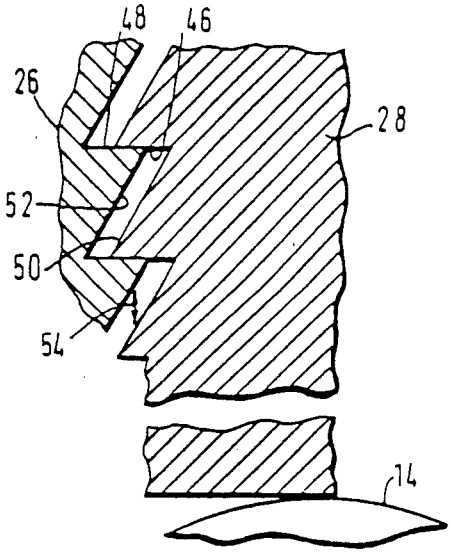
FIG.3
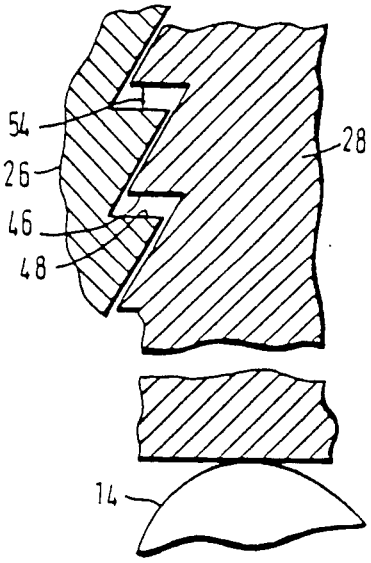
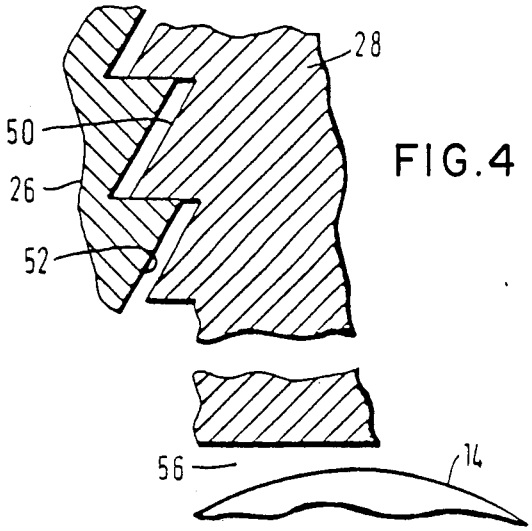
FIG.4

AUTOMATIC CLEARANCE ADJUSTER

This invention relates to a mechanical automatic clearance adjuster as may be used, for example, as a valve clearance adjuster for a valve operating mechanism as is described in British Pat. No. 2 033 472 and European Pat. No. 0 032 284. However the present invention is not limited to a clearance adjuster for use in a valve operating mechanism as it may find application in other fields, eg as a drive belt slack adjuster or as a levelling device.

The valve clearance adjuster describe in British Pat. No. 2 033 472 and European Pat. No. 0 032 284 comprises two complementarily screw threaded components exhibiting a higher friction in one direction of axial loading compared with the friction in the opposite direction of axial loading. In one embodiment of adjuster described and illustrated in the aforesaid patents, an externally threaded screw member runs within a complementarily internally threaded bush which bush comprises an integral part of one end of a rocker arm; the screw member being disposed between a spring, at one end, and a cam or cam-operated push-rod at the other end. In another embodiment, the screw member comprises an integral end part of a valve stem which part runs within a complementarily internally threaded bush in a bucket type tappet; such arrangement being particularly applciable to an overhead cam valve operating mechanism.

It has now been found that the types of valve clearance adjuster described above may be replaced in some applications by a self-contained clearance adjuster which, as stated in the opening paragraph above, may have uses outside those of valve operating mechanisms.

Hence it is a broad object of the present invention to provide an improved construction of mechanical automatic clearance adjuster. However, the clearance adjuster of the present invention will find particular application as a valve clearance adjuster particularly in situations where it may be located in the actual cylinder head of an internal combustion engine.

In accordance with the broadest aspect of the invention there is provided a mechanical automatic clearance adjuster comprising an internally threaded housing; a screw member within said housing having an external thread from complementary to the internal thread form of the housing, the thread from exhibiting a relatively high friction in one direction of axial loading of the screw threads compared with a relatively low friction in the opposite direction of axial loading; a compression spring within said housing acting between a reaction element on the housing at one end thereof and the screw member to bias the screw member in the said opposite direction of axial loading and thus to urge the screw member in a direction outwardly off the other end of the housing; the thread form being so configured that the screw member will rotate and advance axially of the housing solely under the axial thrust of the compression spring.

The reaction element conveniently comprises an end cap at said one end of the housing which may be secured to the housing by, for example, screw threaded engagement therewith or, alternatively, such end cap may be integral with said housing. The compression spring preferably comprises a coil compression spring which is conveniently located between a recess in the end cap and a bore formed centrally of the screw member.

The complementary threads of the housing and the screw member are preferably of buttress thread form and are preferably so configured to have a helix angle H, a first flank termed a running flank and having a flank angle $G_R$ and a second flank termed a locking flank and having a flank angle $G_L$ satisfying the conditions that:

(a) $\tan H > \mu_{MAX} \sec G_R$;

(b) $\tan H < \mu_{MIN} \sec G_L$; and (c) $\cot G_L > \mu_{MAX} \cos H$; where $\mu_{MAX}$ and $\mu_{MIN}$ are respectively the highest and lowest expected values of the coefficient of friction between the co-operating flanks of the threads of the housing and the screw member whereby the screw threads exhibit the said high friction between the locking flanks having said second flank angle $G_L$ under axial loads applied to either the housing or the screw member in the said one direction compared with the said low friction between the running flanks having said first flank angle $G_R$ under forces transmitted by the compression spring in the said opposite direction.

The mechanical automatic clearance adjuster of the invention may comprise a valve clearance adjuster for a valve operating mechanism of an internal combustion engine and, in such an application, it may be desirable to incorporate an anti-rotation element non-rotatably mounted at that said other end of the said housing to which the screw member is urged by the spring loading, said screw member having an end surface at that end thereof remote from the spring loading and said anti-rotation element having an end surface directed axially inwardly of the housing in contact with said end surface of the screw member whereby rotative components transmitted to either said one end of the housing or to the free end of the anti-rotation element by valve-opening forces are not transmitted between the housing and the screw member.

Said respective contacting end surfaces of the screw member and of the anti-rotation element may be contiguous planar surfaces or may be contiguous surfaces of revolution e.g. conical.

Such an anti-rotation element may be formed of a metal or of a ceramics material. Such element may include one or more projections matingly engaged in one or more corresponding recesses in said one end of the housing. Alternatively, and particularly if the element is formed of a ceramics material, the element may have a non-planar surface, e.g. a sinusoidal surface, engaged with a corresponding non-planar surface at the said one end of the housing for inhibiting rotation of the said element relative to the housing.

Thus the invention provides a mechanical automatic clearance adjuster as a self-contained unit comprising the housing, the screw member and a compression spring for said spring loading. When used as a valve clearance adjuster for a valve operating mechanism of an internal combustion engine, the adjuster is locatable in the cylinder head of the engine and, as mentioned above, in such an engine application, the adjuster may further include an anti-rotation element as part of the self-contained unit.

Other features of the invention will become apparent from the following description given herein solely by way of example with reference to the accompanying drawings which illustrate use of the mechanical automatic clearance adjuster as valve clearance adjuster in a valve operating mechanism of an internal combustion engine and wherein:

FIGS. 2–4 are schematic representations of the positional relationship of the thread forms of the housing and the screw member of the adjuster during a sequence of valve-opening and valve-closing loads applied by the cam.

Figure 1:
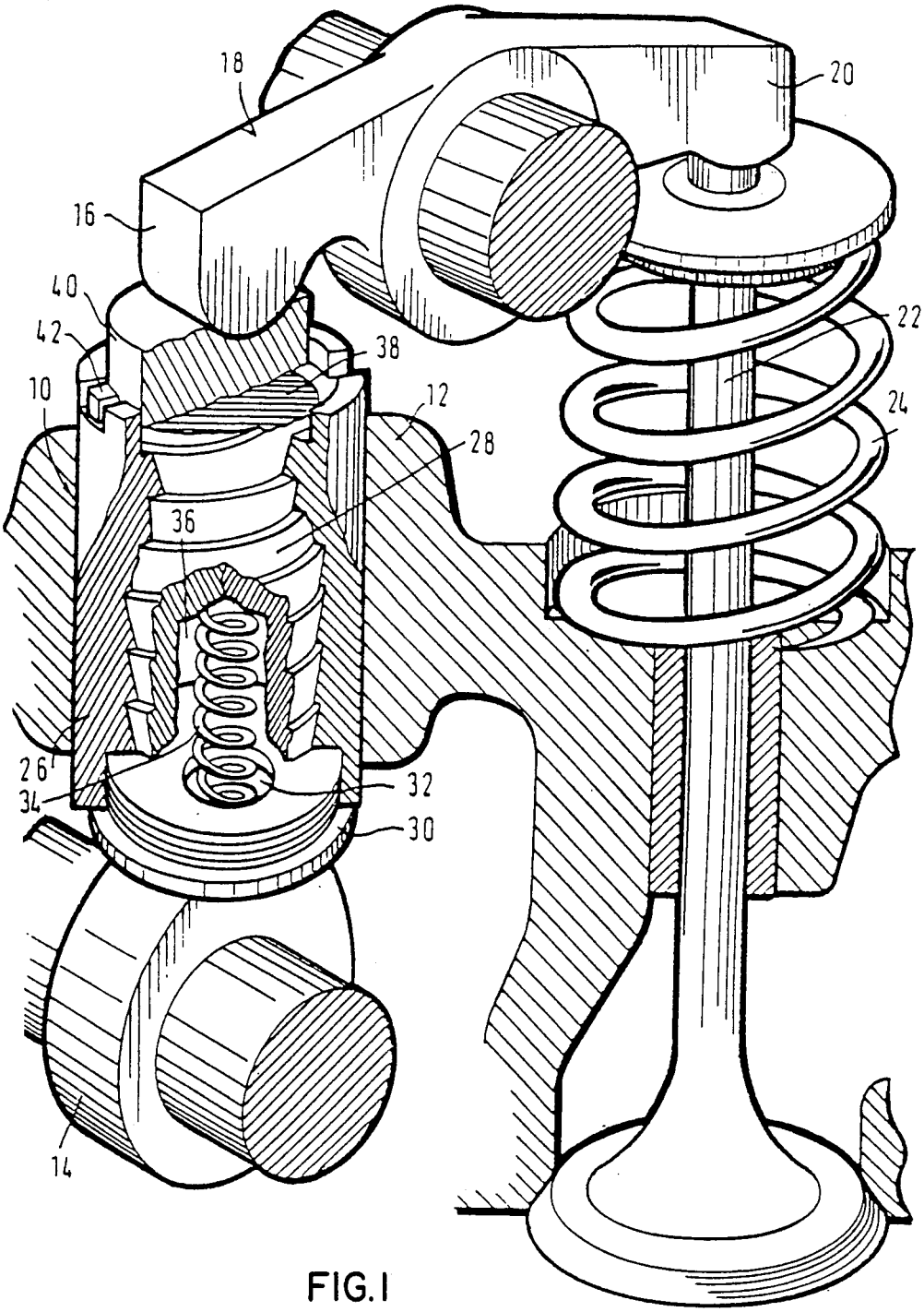
FIG. 1 is a cut-away perspective view showing the adjuster of the invention located in the cylinder head of a cam-in-head engine with a rocker arm valve operating mechanism.

In the embodiment illustrated herein in FIG. 1, the mechanical automatic clearance adjuster comprises a valve clearance adjuster for a valve operating mechanism of an internal combustion engine; the adjuster being in the form of a self-contained "capsule" tappet 10 located at an appropriate position in the cylinder head 12 of a cam-in-head engine. The capsule tappet thus replaces the conventional hydraulic tappet between the cam 14 and one end 16 of a pivotally mounted rocket arm 18, the other end 20 of which bears upon the free end of a valve stem 22. Valve opening forces are thus transmitted to the valve from the cam 14 through the capsule tappet 10 of the invention and the rocker arm 18 and valve closing forces are imparted by the usual type of coil compression spring 24.

The clearance adjuster, or capsule tappet 10, comprises a cylindrical steel housing 26 open at both ends and having, over the major portion of its length, an internal thread of buttress thread form. Within the housing there is a screw member 28 having an external buttress thread form complementary to the internal thread form of the housing 26. The housing includes an end cap 30 in screw threaded engagement at one end of the housing and having a central recess 32 to locate a coil compression spring 34 which extends within a central bore 36 of one end of the screw member 28 thereby to bias the screw member outwardly of the other end of the housing.

As will be seen from the drawings, and as is described in more detail below, the buttress thread form is so configured as to exhibit a relatively high friction in one direction of axial loading of the screw threads compared with a relatively low friction in the opposite direction axial loading whereby the screw member 28 may rotate and advance axially of the housing 26 solely under the purely axial thrust of the compression spring 34. That is to say, as illustrated, the compression spring 34 urges the screw member 28 to run freely upwardly of the housing 26 at all times.

As illustrated, the upper, or free end of the screw member 28 comprises a planar surface 38 which may bear directly upon the one end 16 of the rocket arm. However, as illustrated, an anti-rotation element 40 is non-rotatably mounted relative to the housing 26 at the upper end thereof and comprises a cylindrical element having diametrically opposed locating lugs 42 engaged within co-operating slots formed in the housing end. The lower face of the anti-rotation element 40 also comprises a planar surface in contact with the upper planar surface 38 of the screw member 28. Such anti-rotation element may conveniently be formed of a ceramics material having good wear resistance.

The provision of an anti-rotation element 40 is not essential to the adjuster of the present invention in its broadest concept but, when an anti-rotation element is provdied, it may, as an alternative to the form described above, comprise a ceramics material in the form of a substantially cylindrical element. Such element would have a planar surface in contact with the upper planar surface 38 of the screw member 28 but could also be provided with an annular shoulder having a non-planar surface bearing upon and engaging with a corresponding non-planar surface formed on the upper end of the housing 26. Such non-planar co-operating surfaces may for example comprise sinusoidal surfaces.

In the application described and illustrated herein, the adjuster 10 is used to automatically adjuste the valve train to take up any excess clearance and the mode of operation will now be described with reference to FIGS. 2–4. When the cam 14 is in the rotational position shown in FIG. 2 there is no valve operating load on the screw member 28 and the compression spring 34 therefore ensures that the faces of the running flanks 46 and 48 of the buttress thread forms respectively of the screw member 28 and the housing 26 are in contact. Between the respective locking flank faces 50 and 52 of the screw member and the housing there is therefore a clearance 54 in an axial direction which is a predetermined proportion of the required clerance in the valve mechanism.

Figure 5:
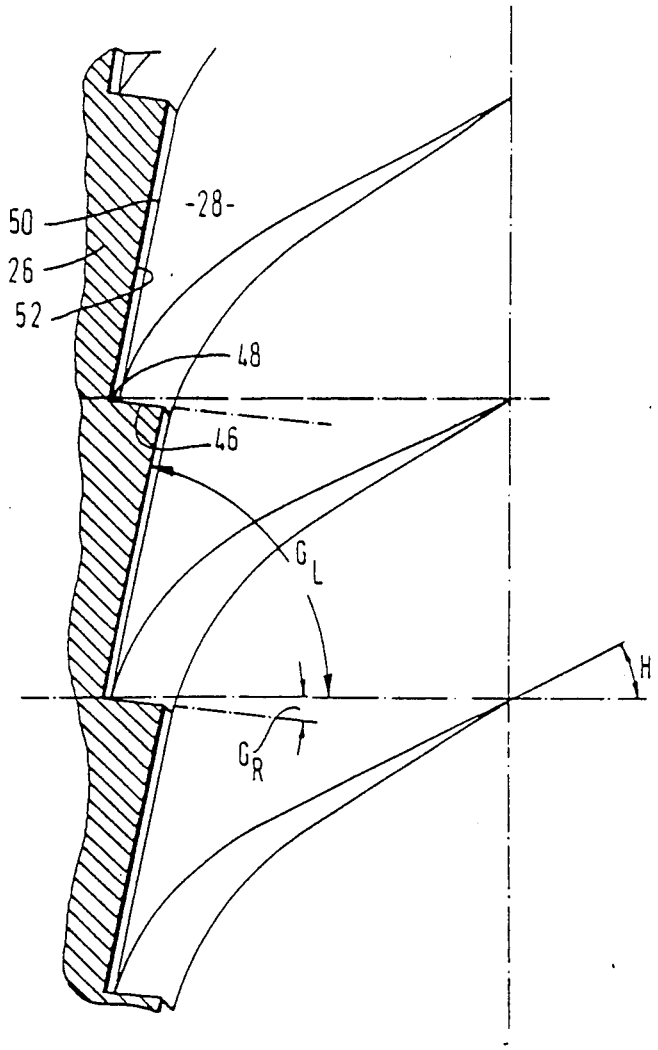
FIG. 5 is an enlarged schematic representation of the positional relationship of the thread forms of the housing and the screw member.

It should be noted that, in FIGS. 2–4, and in FIG. 5, the screw member 28 and the housing 26 are shown located relative to the cam 14 in a position inverted to the position shown in FIG. 1. However, for the purposes of explaining the operation and function of the thread forms, it is immaterial as to which direction is taken up by the screw member and housing since the following description of the action of the cam 14 on the screw member is equivalent to describing the action with respect to the reactive load of the rocker arm end 16 on the screw member. Thus, although FIG. 2 illustrates that there is no other clearance in the mechanism since the lower end of the screw member is in contact with the cam 14, this is equivalent to saying that, with respect to FIG. 1, the cam 14 is just in contact with the end cap 30 of the housing.

Thus with respect to the remaining FIGS. 3 and 4, when the cam 14 rotates it applies a load to the screw member 28 which moves the screw member parallel to its axis (ie vertically upwardly as illustrated) giving a clearance 54 between the running flanks 46 and 48 as shown in FIG. 3. The locking flank faces 50 and 52 of the threads come into contact where they are substantially wedged due to the high friction between these faces pursuant to the particular configuration of buttress thread form. Rotational movement of the screw member 28 relative to the housing 26 is substantially prevented by this wedging action of the buttress thread form and, consequently, valve opening forces can be transmitted from the cam 14 and via the rocker arm 18 to the valve.

FIG. 4 shows a notional position when wear in the mechanism has occured but no adjustment has taken place. This wear may, for example, take place at the interface of the mechanism and the cam and is illustrated by a gap 56 at this interface in FIG. 4. In this situation the total clearance in the valve mechanism is the desired clearance between the flanks 46 and 48 plus the additional wear clearance 56 at the interface. In this situation the force of the compression spring 34 is acting to urge the screw member 28 and housing 26 to separate axially through the low friction faces of the running flanks 46 and 48, of the screw threads. This friction is sufficiently low to cause the screw member 28 to rotate relative to the housing 26 and move outwardly thereof until the whole of the gap 56 at the inteface has been taken up at which time the configuration of the mechanism corresponds to that shown in FIG. 2. Thereafter the valve mechanism operates as described with reference to FIGS. 2 and 3 until such time as the clearance again increases as a result of further wear. In practice the adjustment take place gradually as wear occurs with the result that no substantial excess clearance 56 as shown at the interface ever occurs. In this way the valve mechanism is self-adjusting and compensates for wear.

Referring now to the enlarged detailed view of FIG. 5 it will be seen that the buttress thread forms are provided with a helix angle H; a first running flank with a flank angle $G_R$ and a second locking flank with a flank angle $G_L$. The actual relationship between the helix angle H, and the flank angles $G_R$ and $G_L$ is derived from three conditions which are now described with reference to the graph of FIG. 6:

CONDITION A

Referring to FIGS. 2 to 4, when the valve opening force is zero the force imparted by the spring 34 must be able to (a) push the screw member 28 downwardly to cause its running flank 46 to make contact with the running flank 48 of the thread in the housing 26, and (b) cause the screw member 28 to rotate and advance axially downwardly in order to take up any clearance in the valve gear. This axial advance must be attainable in this way even when the co-efficient of friction $\mu$ is unfavourably high, for example having a value $\mu=0.2$. For this rotational and axial movement to be possible the tangent of the helix angle H must exceed the product of the secant of the flank angle $G_R$ multiplied by the co-efficient of friction i.e., $\tan H > \mu \sec G_R$.

Figure 6:
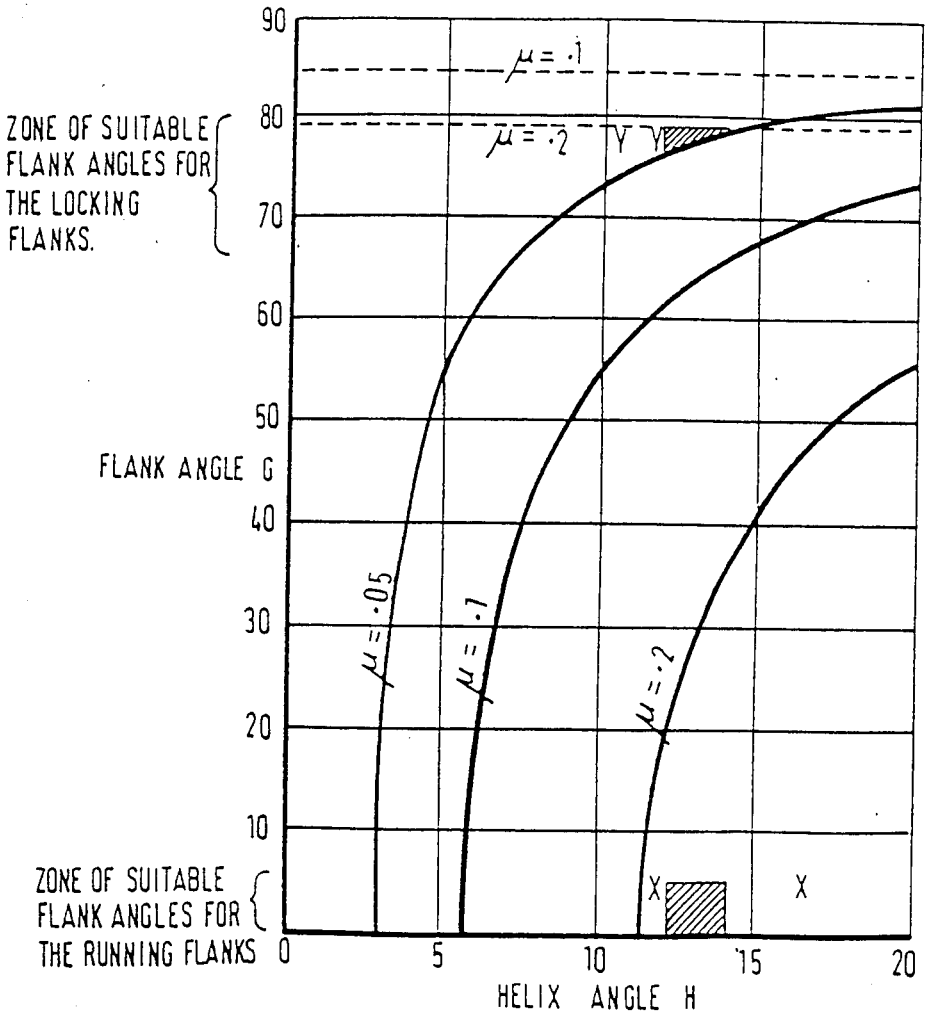
FIG. 6 is a graph relevant to the thread form plotting the flank angle against the helix angle.

This is equivalent to stating that, with reference to FIG. 6, the plot of the running flank angle ($0<G_R<5°$) against the helix angle H must lie in the zone XX, i.e., to the right of the curve marked $\mu=0.2$.

CONDITION B

When the valve opening force overcomes the force of the spring 34, and the locking flank 50 of the screw member 28 is forced into contact with the locking flank 52 of the housing 26, the frictional resistance at the contacting surfaces must be sufficient to prevent the screw member 28 from rotating within the co-operating screw threaded housing 26 even when the co-efficient of friction has an unfavourably low value for example $\mu=0.05$. For the prevention of this rotation, the tangent of the helix angle H must be less than the product of the secant of the flank angle $G_L$ multiplied by the co-efficient of friction i.e., $\tan H < \mu \sec G_L$.

This is equivalent to stating that, with reference to FIG. 6, the plot of the locking flank angle ($70° < G_L < 80°$) must lie in the zone YY. i.e., upwards and to the left of the curve marked $\mu=0.05$.

CONDITION C

When the valve opening force is removed, the spring force must be capable of breaking the contact which is taking place on the respective high angle flanks 50 and 52 of the screw threads of the screw member 28 and housing 26. In other words, the flank angle $G_L$ must be less than a value which would cause the threads to stick permanently together as a result of the action of the valve opening force even when the co-efficient of friction has an unfavourably high value for example such as $\mu=0.2$. This frictional sticking can be avoided by making the co-tangent of the flank angle $G_L$ greater than the product of the cosine of the helix angle H and the co-efficient of friction i.e., $\cot G_L > \mu \cos H$.

This is equivalent to stating that, with reference to FIG. 6, the plot of the flank angle ($70° < G_L < 80°$) must lie in the region YY i.e., below the dashed line marked $\mu=0.2$.

Thus for $\mu_{MAX}=0.2$ and $\mu_{MIN}=0.05$, suitable values for helix angle (11°–14°), running flank angle (0°–5°) and locking flank angle (76°–79°) are shown by the two shaded areas.

In the graph of FIG. 6 the dashed lines for the co-efficient of friction marked as $\mu=0.1$ and $\mu=0.2$ satisfy the condition $\cot G = \mu \cos H$ whereas the continuous curves marked as $\mu=0.05$; $\mu=0.1$ and $\mu=0.2$ satisfy the condition $\tan H = \mu \sec G$.

Referring again to FIGS. 2 to 4, the screw member 28 is always spring loaded by the spring 34 to produce contact between the running flanks 46 and 48 of the screw threads. If there should be any clearance in any part of the valve system, the screw member 28 immediately takes up this clearance by rotating and advancing axially of the housing 26. The spring 34 is able to move the screw member 28 in this manner because of the high helix angle H and because the running thread flanks 46 and 48 offer a relatively low frictional resistance.

Thus the automatic clearance adjuster always eliminates any tendency for clearance to begin to form between any of the elements of the valve gear train.

However there is always the controlled axial gap between the co-operating buttress screws threads and the magnitude of this gap is governed entirely by the tolerances to which the co-operating threads are manufactured. Thus this axial gap 54 always ensures that the valve is fully closed when the cam is on its low radius profile; thus when cam rotation begins to lift the adjuster housing 26, the screw member 28 has to rise through the axial gap 54 before the rocker arm 18 can begin to open the valve.

When the screw member 28 has been raised through this axial gap in this manner, the locking flanks 50 and 52 of he co-operating screw threads are in contact with one another. The locking flank angle $G_L$ has the effect of increasing the co-efficient of friction between the screw threads by a factor of approximately 4.8 ($1/\cos G_L$). Thus, in spite of the high helix angle H, there can be no relative motion between the co-operating screw threads as the lift of the cam 14 is transmitted directly to the rocker arm 18 to open the valve.

As mentioned above, the automatic clearance adjuster described herein may or may not be provided with the antirotation element 40 as illustrated in FIG. 1. The need for an anti-rotation element occurs due to the fact that, in some engines, excessive rotational components are imparted to the tappet due to the particular profile of the cam and such forces could tend to rotate the screw member 28 against the direction of rotation imparted by the compression spring 34. That is to say, the screw member could be caused to "back-off" to an undesirable extent from its optimum clearance position relative to the housing 26.

However the mechanism should be capable of providing an increased clearance, ie by back-off, if the clearance of the mechanism should reduce below a minimum requirement. It is believed that this back-off capability may be achieved in the adjuster of the present invention, with or without the provision of an anti-rotation element, despite the apparent theoretical situation which occurs as previously described with reference to FIGS. 2–4 in which it was stated that the thread flanks 50 and 52 wedge together to prevent rotation during the application of valve opening forces. Laboratory observations indicate that when the cam applies valve opening forces and the thread flanks are approaching contact (as shown in FIG. 3) then, for a very short time, the friction conditions on the thread flanks 50 and 52 are very low as a result of continuous oil film lubrication and so, during this short time on every valve opening movement, the consequent compressive axial force produces a small back-off rotation of the screw member relative to the housing in a direction opposite to that normally induced by the compression spring 34.

When an anti-rotation element 40 is fitted as illustrated, then in addition to the friction conditions between the thread flanks 50 and 52 as described in the preceding paragraph, there is also contact between the planar surfaces of the anti-rotation element and the screw member. The continuous oil film lubrication between such planar surfaces provides a very low friction condition between the two surfaces so that, again, during a short time on every valve opening movement the compressive axial force is transmitted through the oil film to induce the small back-off rotation of the screw member 28 relative to the housing 26 in the direction opposite to that normally induced by the compression spring 34.

The magnitude of this back-off rotation, by careful design of the interfaces between the screw member and the anti-rotation element, can be such that it is too small to upset the ability of the mechanism to control tappet clearance whilst, at the same time, giving the adjuster the following advantages:

1. In some engines, wear and dimensional changes due to temperature cause a reduction in tappet clearance. This reduction occurs very slowly and so the aforesaid small back-off rotation of the screw member relative to the housing can be made to counteract such reductions and so maintain tappet clearance at the desired value.

2. It is conceivable that the screw member could rotate relative to the housing from the position shown in FIG. 2 to the position shown in FIG. 3 without any axial movement of the screw member relative to the housing. If this position did develop in practice there would be zero tappet clearance. It follows from (1) above that the small back-off rotation of the screw member relative to the housing would prevent this position from occuring.

It will be appreciated that the foregoing description is with reference to the specific example illustrated in FIG. 1 of the drawings which is a mechanical automatic valve clearance adjuster in direct line between a cam 14 and a rocker arm 18 in an internal combustion engine valve train mechanism. However, in use of the clearance adjuster of the invention as a valve clearance adjuster, the capsule tappet may be located at alternative positions in the valve train. For example, it may be located above the valve in an overhead cam layout or it may constitute a fulcrum point, ie not in direct transmission line, for a finger-type valve mechanism. In this latter application, the use of an anti-rotation element is, of course, completely redundant as no rotational components of any kind are imparted to the tappet.

In any of the applications described above the capsule tappet comprising the screw member 28 and its housing 26 may be either in the orientation shown in FIG. 1 or in the orientation shown in FIGS. 2–5. In other words, the relative orientation of the capsule tappet as a whole is irrelevant; the only proviso being that the direction of action of the coil compression spring 34 within the tappet is such as always to urge the screw member 28 in the free-running direction outwardly of the housing 26, ie to urge the low friction running flanks 46 and 48 into contact with one another.

It will also be appreciated that the mechanical automatic clearance adjuster of the invention is not restricted to its use in conjunction with a valve train mechanism. The adjuster of the invention, being a self-contained capsule device, can be used in other applications such as, for example, a self-levelling device at the base of items to be stood level on an uneven surface or, alternatively, the capsule adjuster could be used to maintain permanent pressure on an item where slack is to be taken up such as in a drive belt.

I claim:

1. A self-contained mechanical automatic clearance adjuster comprising a housing having an internal buttress thread form and a screw member within said housing having an external buttress thread form complementary to and cooperatingly engaged with the internal buttress thread form of the housing, said cooperating thread forms exhibiting a relatively high friction in one direction of axial loading of the screw threads compared with a relatively low friction in the opposite direction of axial loading; a compression spring within said housing acting between a reaction element on the housing at one end thereof and the screw member to bias the screw member in the said opposite direction of axial loading and thus to urge the screw member in a direction outwardly of the other end of the housing; the thread forms being so configured that the screw member will rotate and advance axially of the housing solely under the axial thrust of the compression spring; the buttress thread forms of the housing and the screw member having a helix angle H, a first flank termed a running flank and having a flank angle $G_R$ and a second flank termed a locking flank and having a flank angle $G_L$ satisfying the conditions that:

(a) $\tan H > U_{MAX} \sec G_R$;

(b) $\tan H < U_{MIN} \sec G_L$; and (c) $\cot G_L > U_{MAX} \cos H$; where $U_{MAX}$ and $U_{MIN}$ are respectively the highest and lowest expected values of the coefficient of friction between the co-operating flanks of the threads of the housing and the screw member whereby the screw threads exhibit the said high friction between the locking flanks having said second flank angle $G_L$ under axial loads applied to either the housing or the screw member in the said one direction compared with the said low friction between the running flanks having said first flank angle $G_R$ under forces transmitted by the compression spring in the said opposite direction.

2. A self-contained mechanical automatic clearance adjuster as claimed in claim 1 characterized in that it is provided as a self-contained valve clearance adjuster for a valve operating mechanism of an internal combustion engine.

3. A mechanical automatic clearance adjuster as claimed in claim 2 further characterised in that an anti-rotation element (40) is non-rotatably mounted at that end of the housing to which the screw member is urged by the compression spring, said anti-rotation element having an end surface directed axially inwardly of the housing in contact with an end surface (38) of the screw member whereby rotative components transmitted to eithr the one end of the housing or the free end of the anti-rotation element by valve opening forces are not transmitted between the housing and the screw member.

4. A mechanical automatic clearance adjuster as claimed in claim 3 further characterised in that said respective contacting end surfaces of the screw member and of the anti-rotation element comprise contiguous planar surfaces.

5. A mechanial automatic clearance adjuster as claimed in claim 3 further characterised in that said respective contacting end surfaces of the screw member and of the anti-rotation element comprise contiguous surfaces of revolution.

6. A mechanical automatic clearance adjuster as claimed in claim 3 further characterised in that said anti-rotation element (40) is formed of a ceramics material.

* * * * *